US005719564A

United States Patent [19]

Sears

[11] Patent Number: 5,719,564

[45] Date of Patent: Feb. 17, 1998

[54] UTILITY METER READING SYSTEM

[76] Inventor: Lawrence M. Sears, 23905 Mercantile Rd., Beachwood, Ohio 44122

[21] Appl. No.: 644,501

[22] Filed: May 10, 1996

[51] Int. Cl.[6] ..... G08B 23/00

[52] U.S. Cl. ..... 340/870.02; 340/870.03; 340/870.11; 340/825.54; 340/870.04

[58] Field of Search ..... 340/870.02, 870.03, 340/870.31, 870.15, 870.06, 310.01, 870.11, 825.54, 870.04

[56] References Cited

U.S. PATENT DOCUMENTS

| | | | |
|---|---|---|---|
| 4,057,785 | 11/1977 | Furniss et al. | 340/870.15 |
| 4,396,915 | 8/1983 | Farnsworth et al. | 340/870.03 |
| 4,463,354 | 7/1984 | Sears | 340/870.02 |
| 4,799,059 | 1/1989 | Grindahl et al. | 340/870.03 |
| 4,940,976 | 7/1996 | Gastouniotis et al. | 340/870.02 |
| 5,432,507 | 7/1995 | Mussino et al. | 340/870.03 |
| 5,438,329 | 8/1995 | Gastouniotis et al. | 408/1 R |
| 5,448,230 | 9/1995 | Schanker et al. | 340/870.03 |
| 5,617,084 | 4/1997 | Sears | 340/870.02 |

OTHER PUBLICATIONS

"Walk–By," The Practical Solution to the Inaccessible Meter Problem, Datamatic, Inc. Jul., 1990.

"RadioRead," RadioRead Uses Hi–tech Radio Transmission That Offers Choices and Flexibility, Sensus.

The Utility Open Communication Solution with MAPS™ RF Fixed Networks Schlumberger, Inc.

System 2020™ Two–Way Radio COmmunications for Electric, Gas and Water Network Needs, Iris Systems, Inc.

Datalink — Technology for the 21st Century, Dexter Fortson Associates, Inc.

Tract — the Trace™ Radio Frequency Meter Reading System, Badgar Meter, Inc./Utility Division.

*Primary Examiner*—Jeffery Hofsass
*Assistant Examiner*—Albert K. Wong

[57] ABSTRACT

A method for communicating utility usage-related information from a plurality of meter modules to a plurality of data accumulator units, each of which periodically transmits data to a control computer, including the steps of periodically transmitting from each meter module a first signal indicative of utility usage-related information and wherein the first signal includes a flag for self-configuring the communications network when the meter module is initially installed. The signal strength of the first signals from a meter module received at a data accumulator unit are measured and ranked by the control computer based on received signal strength. The ranking based on signal strength is utilized to enable only a limited number of data accumulators (those which received the strongest first signals) to receive, record and store data from a particular meter module.

30 Claims, 4 Drawing Sheets

UTILITY METER READING SYSTEM

DESCRIPTION

1. Technical Field

The present invention relates to a method and apparatus for communicating utility usage-related information such as meter identification data and utility usage data from a plurality of meter modules, each of which senses, stores and periodically transmits utility usage information via an RF link to a plurality of spaced-apart data accumulator units, each of which receives from a plurality of meter modules a plurality of first signals indicative of the utility usage information associated with the meter module which transmits the signal. The data accumulator units then periodically transmit information to a control computer which downloads the data to a utility computer network which then processes the data and produces billing information. Redundancy of signals sent to the data accumulator units assures reliable signal reception in various propagation environments and the control computer minimizes redundant signals from a particular meter module from being processed by an unnecessarily large number of data accumulator units so as to to significantly reduce the amount of data processed while still obtaining accurate information.

2. Background of the Invention

Meter reading systems are well known in the art. Such known systems include hand-held units and remote units which can read meters from a short distance and walk-by or drive-by systems which read meters via a short RF link (1" to 500') with a receiver located in a vehicle or hand held which is passed by the structures including the utility meters. Such a system is disclosed in U.S. patent application Ser. No. 08/119,986 filed Sep. 10, 1993 entitled "Apparatus for Communicating Utility Usage-Related Information from a Utility Usage Location to a Utility Usage Registering Device," which is incorporated herein by reference.

It is now desired to utilize a wide area, centralized reading system. Such systems increase the accessibility to meter data by enabling a meter to be read on a schedule or on demand as desired from a central location. Such a system eliminates meter readers and significantly reduce the cost of meter reading.

Known problems are associated with RF communications between the meter transmitters and the data receivers. The propagation of the transmission signal from the meter module is dependent upon topography, meter location, and local conditions such as interference, storms, and obstructions. The signals from the meter modules tend to attenuate in various environments and do not propagate in a uniform fashion.

To increase the probability that an accurate signal will be received from the meter modules, the data receiver which receives the signal from the meter module can be moved closer to the meter module. However, reducing the spacing between the meter modules and the data receiver requires increasing the number of data receivers. Additionally, since each meter module will transmit to all receivers or data accumulator units within its transmission range, a plurality of data accumulator units within range of a particular meter module will each receive signals from the particular meter module. This results in the data accumulator units receiving a plurality of redundant signals from a particular meter module. It has been found that particular data accumulator units located in densely populated areas could receive as many as 100,000 messages, the vast majority of which are redundant, from various meter modules in a 12 hour period.

This results in the data accumulator units, the communications network, and other data processors processing large volumes of redundant data.

Hence, although it is desirable to receive the signals from each meter module at more than one data accumulator unit to enhance the probability of accurate reception, it is further desirable to reduce the redundancy of signals processed by the meter reading system so as to not overburden the data processing system.

The present invention overcomes the disadvantages associated with the prior art meter reading systems by automatically reducing the redundancy of the processed signals based on the strength of the signal received from a particular meter module at the plurality of data concentrator units.

SUMMARY OF THE INVENTION

The present invention provides a new and improved method of communicating utility usage-related information from a plurality of meter modules, each of which senses, stores and periodically transmits utility meter-related information from its associated utility meter to a plurality of spaced-apart data accumulator units, each of which receives from a plurality of meter modules, a plurality of first signals, each of which is indicative of the utility usage information associated with the meter module which transmits the first signal, and which further periodically transmits data indicative of some of the first signals received from the data accumulator units to a control computer, including the steps of periodically transmitting from the meter modules a signal indicative of utility usage-related information, receiving at each of the data accumulator units first signals, each of which is transmitted by its associated meter module, storing at the data accumulator units data indicative of utility-related information received by the data accumulator units from some of the first received signals, transmitting to the control computer from each of the data accumulator units information which is indicative of the utility usage information sensed by the plurality of meter modules, and periodically transmitting a flag in the first signal for a predetermined time period.

The present invention further provides a new and improved method of communicating utility usage-related information as set forth in the preceding paragraph wherein the signal strength of each of the received signals including a flag is determined and stored at the data accumulator units, and wherein the received signal strength is transmitted to the control computer which ranks, by the received signal strength, each of the received first signals including a flag, and enables only those limited number of data accumulator units which have received the strongest first signal based on rank from a particular meter to store and process the data indicative of utility usage-related information at that particular meter.

The present invention further provides a method of communicating utility usage-related information from a plurality of meter modules to a plurality of spaced-apart data accumulator units and further to a control computer, including the steps of periodically transmitting from each of the meter modules a first signal indicative of utility usage-related information, receiving at each of the data accumulator units a plurality of first signals, storing at the data accumulator units data indicative of utility-related information, transmitting to the control computer data from the data accumulator units, and wherein the step of periodically transmitting the first signal from each of the meter modules includes the steps of periodically transmitting at a first periodic frequency the first signal from each of the meter modules, and periodically transmitting at a second periodic frequency, which is substantially larger than the first periodic frequency, the first signal from each of the meter modules. The step of periodically transmitting at the second periodic frequency is performed for a predetermined period of time when each of the meter modules is initially installed at its associated utility meter.

Still another provision of the present invention is to provide a new and improved method of communicating utility usage-related information from a plurality of meter modules to a plurality of data accumulator units and then to a control computer, including the steps of periodically transmitting from each of the meter modules a first signal indicative of utility usage-related information, receiving at each of the plurality of data accumulator units a plurality of first signals, determining the signal strength of the received first signals at each of the data accumulator units, storing at each of the data accumulator units the signal strength of the first signals received from each particular meter module which is within transmitting range of each data accumulator unit, storing of each data accumulator unit data indicative of utility usage information received in the first signal, determining which data accumulator units received the strongest signals, enabling only a limited number of data accumulator units which received the strongest signals from a particular meter module to store the data indicative of utility usage, and transmitting to the control computer data from each of the data accumulator units which is indicative of utility usage-related information sensed by the plurality of meter modules.

DESCRIPTION OF THE PREFERRED EMBODIMENT

Figure 1:
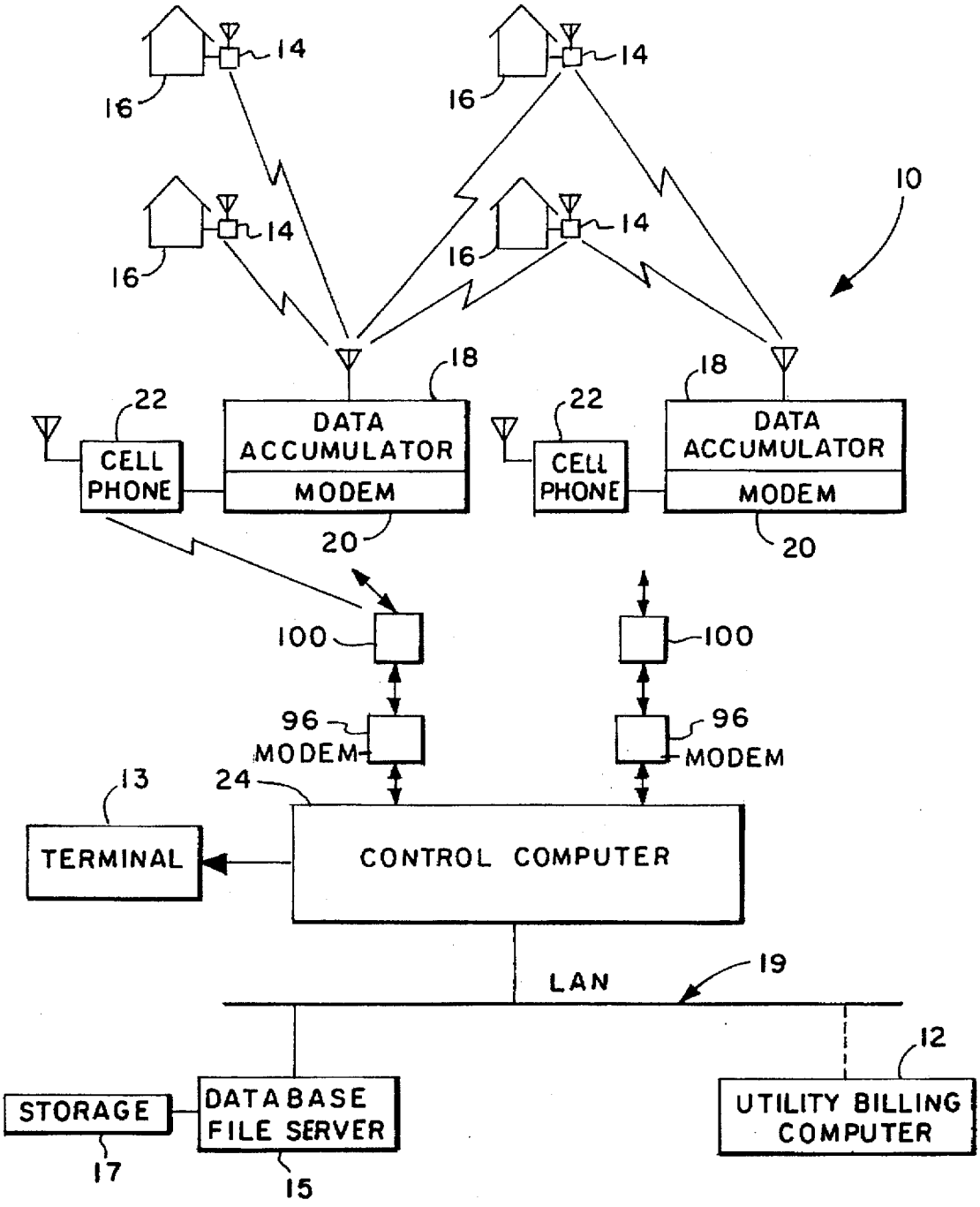
FIG. 1 is a schematic representation of the meter reading system of the present invention.

Referring to the Figures, and more particularly to FIG. 1, a meter reading system 10 is disclosed for communicating utility usage-related information to a central computer 12 which is preferably located at the utility headquarters. The meter reading system 10 includes a plurality of meter modules 14, each of which is associated with a utility meter 11 located at its associated utility usage location 16. Each meter module 14 stores an identification number therein indicative of the particular utility meter being read, collects usage data, senses tamper, and includes a one-way, pseudo-random transmitter which periodically transmits, via an RF link, at a pseudo-random transmission frequency a first signal indicative of the utility usage-related information sensed and stored in the meter module 14. The pseudo-random transmission frequency of the first signal is transmitted at a fixed carrier frequency at a transmission rate or interval which is pseudo-random. For example, the meter module 14 may tranmit on a carrier frequency of 450 MHz every approximately eleven hours i.e. the psudo-random transmission frequency.

Figure 2:
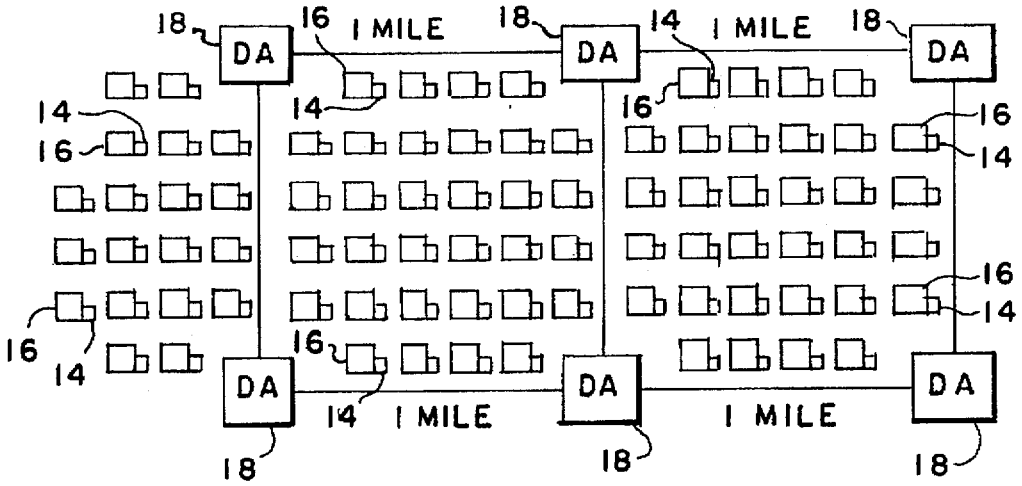
FIG. 2 is a schematic representation of the grids established between the plurality of meter modules and the plurality of data accumulator units.

A plurality of data accumulator units 18 are spaced apart among the plurality of meter modules 14. Each data accumulator unit 18 collects transmitted messages from a plurality of meter modules 14 and retransmits the messages via a modem 20 and a cell phone 22 to a control computer 24. In the preferred embodiment, the data accumulator units 18 are spaced apart in a redundant grid, as is illustrated in FIG. 2, to increase the probability of reception by more than one data accumulator unit 18 of signals transmitted by each of the plurality of meter modules 14. Typical spacing between data accumulator units is one mile, and each data accumulator unit 18 serves up to several thousand meter modules 14. While a cell phone 22 has been illustrated to communicate between the data accumulator units 18 and the control computer 24, other data links, such as RF, phone lines, cable, or photo-optic transmissions means can be utilized in a well-known manner to connect the data accumulator units 18 to the control computer 24.

The data accumulator units 18 transmit the data stored therein indicative of utility usage at the meter modules to the control computer 24 which analyzes and filters redundant messages received by multiple data accumulator units. The control computer 24 functions as the gateway to the utility billing system, including the utility billing computer 12, and controls the schedule for the download of data from the data accumulator units 18. In addition, the control computer 24 functions to provide maintenance and management reports to the network manager. A terminal 13 can be connected to the control computer 24 to provide access by the network manager to the communicating network in a well-known manner. A suitable database file server 15 for storing information related to each of the utility use locations 16 in the storage means 17 is connected to the utility billing computer 12 and the control computer 24 through a local area network 19 in a well-known manner. The storage means 17 can be any known data storage means such as a tape drive or hard disc.

Each of the meter modules 14 normally transmits its first signal indicative of utility usage-related information at a pseudo-random transmission frequency. In the preferred embodiment, each meter module 14 transmits approximately once every 11 hours. This transmission frequency assures that the meter module will transmit a signal to be received by at least one data accumulator unit 18 at least twice per day. The utilization of a periodic transmission from the meter modules 14 approximately every 11 hours enables the time of transmission for each particular meter module 14 to vary so that the meter module 14 does not transmit at the same time each day. This increases the probability of reception of the signals from the meter modules 14 at the data accumulator units 18 even if there is a periodic, daily interference near the meter module 14, i.e. if a signal is not received from a meter module 14 due to interference, the module will next transmit at a different time of day so that the probability of the next signal being jammed by periodic local interference is minimized. Even if one signal is not received by a data accumulator unit, multiple periodic transmissions increase the probability of an accurate reception of the first signal from a meter module 14.

The high probability of reception by the data accumulator unit 18 from each meter module is based on the redundancy of the network (space diversity) and the frequency of transmissions (time diversity). For example, in a hilly area, the probability of reception of transmission signals from a meter module 14 to a single data accumulator unit 18 may be reduced by as much as 50% if only a single data accumulator unit 18 receives signals from the particular meter module 14. However, by providing additional radio paths from the meter module 14 to other data accumulator units 18, the probability of reception of the signal from the meter module being received by at least one data accumulator unit increases to over 99%. In addition, if multiple transmissions occur from the meter module 14, the probability of successful reception increases from 99.1% for a single transmission to 99.99% for two transmissions. Thus, if a particular meter module transmission is not received, it is likely that the next or subsequent transmission will be received.

FIG. 2 illustrates a typical grid of meter modules 14 and data accumulator units 18 wherein the data accumulator units 18 are spaced on a grid approximately one mile apart, and the meter modules 14 are disposed in and around the grid to transmit to the data accumulator units. Typically, each meter module 14 transmits a signal indicative of utility usage over a distance of about one mile but the signal may, in some cases, be received up to three miles away.

The possible reception by more than one data accumulator unit 18 of the message from a single particular meter module 14 increases the probability of reception of the meter module messages but creates a large volume of redundant information. The control computer 24 functions to control the data accumulator units 18 to prevent the storage of redundant information at the data accumulator units 18.

Each data accumulator unit is designed to measure the actual signal strength of a signal received from a meter module 14. The data accumulator units 18 are adapted to store the utility usage information and the measured signal strength associated with the received first signals transmitted by the meter modules 14. Since, as indicated previously, a single data accumulator unit 18 could receive as many as 100,000 transmissions per twelve hour period in a densely populated area, it is desired to reduce the redundancy of information stored by the data accumulator units 18 and subsequently transmitted to the control computer 24.

Upon installation of each meter module 14, the meter module is actuated. Initial actuation of the meter module places the module in a NEWLY INSTALLED MODE. When the meter module 14 is in the NEWLY INSTALLED MODE, the meter module transmits a "flag" along with the utility usage-related information. In addition, the periodic transmissions from the meter module 14 (i.e. the frequency of the transmissions, not the designated carrier frequency of the signal) are at a significantly faster periodic frequency, such as one transmission per hour, than when the meter module is in its NORMAL TRANSMISSION MODE. Thus, each meter module is adapted to transmit in two distinct modes. In the NEWLY INSTALLED MODE, the periodic transmission frequency is increased, and a flag is included in the first signal. In the NORMAL TRANSMISSION MODE, the periodic frequency of transmission is reduced to about one transmission per eleven hours, and a flag is not included in the first signal transmitted by the meter module. The use of a flag in the first signal and the increase in periodic frequency of transmissions enables significant data to be quickly accumulated at the data accumulator units 18 to allow the control computer 24 to self-configure the meter reading system 10. The slower periodic frequency of transmission, without a flag, when the meter modules 14 are operating in a normal mode provides longer battery life for the batteries which power the meter module 14 and reduces the number of signals received and processed by the data accumulator units 18 and the associated network.

The meter module 14 can be manually activated to place the meter module in its NEWLY INSTALLED MODE at times other than installation of the meter module if it is desired to reconfigure the meter reading system 10.

The flag included in the first signal is preferably an identifier in the message (first signal) transmitted from the meter module 14 to the data accumulator unit 18. The particular flag data can identify a meter module as being in its NEWLY INSTALLED MODE or can indicate the occurrence of other significant events. The flag, however, could include means other than an identifier in the data of the first signal to indicate to the data accumulator units 18 that the particular signal received is from a meter module 14 operating in its NEWLY INSTALLED MODE. For example, the flag could be a change in the carrier frequency of the first signal rather than particular data included in the first signal.

When a data accumulator unit 18 receives a first signal from a meter module 14, the data accumulator unit 18 senses the signal strength of the received first signal and stores the received signal strength along with the utility usage-related information.

The data in the data accumulator units 18, including the signal strength of each signal, is downloaded to the control computer 24 on demand or on a periodic basis, preferably once per day. When the stored data from the data accumulator units 18 is downloaded into the control computer 24, the control computer 24 ranks each meter module by its received signal strength and identifies which data accumulator units 18 received the strongest receptions from a particular meter module 14. The data redundancy control computer 24 picks the top three or four data accumulator units 18, by rank of signal strength, and enables the selected data accumulator units 18 to receive and store signals received from the particular meter module 14. All other data accumulator units 18 will then be instructed to ignore any signals received from the particular meter module 14. For example, if a meter module 14 is located at 201 Elm Street, the system will determine, by rank, which data accumulator units 18 receive the strongest signal from 201 Elm Street. The three or four data accumulator units 18 which receive the strongest signal (highest rank) from 201 Elm Street are then instructed by the control computer 24 to record and store signals from 201 Elm Street. All other data accumulator units are instructed to ignore any signals from 201 Elm Street. This ranking by signal strength and selecting and enabling of the data accumulator units 18 by the control computer 24 is performed only when a flag is received in the first signal message from a meter module 14. Thus, the flag provides a means of self-configuring the system 10 for reading the meter modules 14 based on the actual received signal strength of the messages from the meter modules 14. The actual received signal strength will be dependent upon local conditions, and the system can configure itself to increase the probability of reception of signals from a particular meter module 14 while reducing the redundancy of data processed by the meter reading system 10.

If in the future the received signal strength from a particular meter module significantly decreases at a particular enabled data accumulator unit 18, the system 10 can reconfigure itself to disenable the data accumulator unit 18 which received the decreased signal strength to eliminate that data accumulator unit 18 as an enabled receiver for the particular meter module. The control computer 24 can then instruct another data accumulator unit 18 to receive, record and store signals from the particular meter module 14. The subsequently enabled data reduction unit 18 to receive, record and store signals from the particular meter module will be based on the ranking of the signal strength from the meter module stored in the control computer 24. This data is accumulated and stored when the meter module 14 is initially installed. For example, if three data accumulator units 18 are designated as enabled data accumulator units for a particular meter module 14 at 201 Elm Street, and subsequently a large structure such as a building is built between the meter module 14 at 201 Elm Street and one of the data accumulator units 18 which has been enabled and instructed to receive, record and store signals from 201 Elm Street, and a decrease in signal strength is sensed at the enabled data accumulator unit 18, then control computer 24 can disenable the particular data accumulator unit 18 which received the first signal whose signal strength decreased by instructing that data accumulator unit 18 to ignore signals from the meter module at 201 Elm Street. The control computer 24 then enables another data reduction unit 18 as prime or enabled data accumulator unit for the particular meter module 14 at 201 Elm Street and instructs the newly enabled data accumulator unit 18 to receive, record and store signals from the meter module at 201 Elm Street. The subsequently enabled data accumulator unit 18 will be based on the rank of its received signal strength as stored in the control computer 24. In this manner, the particular data accumulator units 18 which are designated as prime or enabled data accumulator units for a particular meter module 14 can be controlled so that only data accumulator units which receive a strong signal from a particular meter module 14 are utilized to receive, record and store the utility usage-related information from a particular meter module.

The control computer 24 also controls the download of data from each of the data accumulator units 18. The data reduction control computer 24 can instruct each data accumulator unit 18 to transmit its stored data on demand or on a predefined schedule. Additionally, if desired, the control computer 24 can instruct the data accumulator unit 18 to receive and store data from a particular meter module 14 at the module's next periodic transmission. For example, the data accumulator units 18 may normally transmit data indicative of utility usage of the meter module 14 once per month but if a customer moved, a current reading may be required and the data accumulator may be instructed to send data indicative of utility usage of a particular meter at the next transmission.

Figure 3:
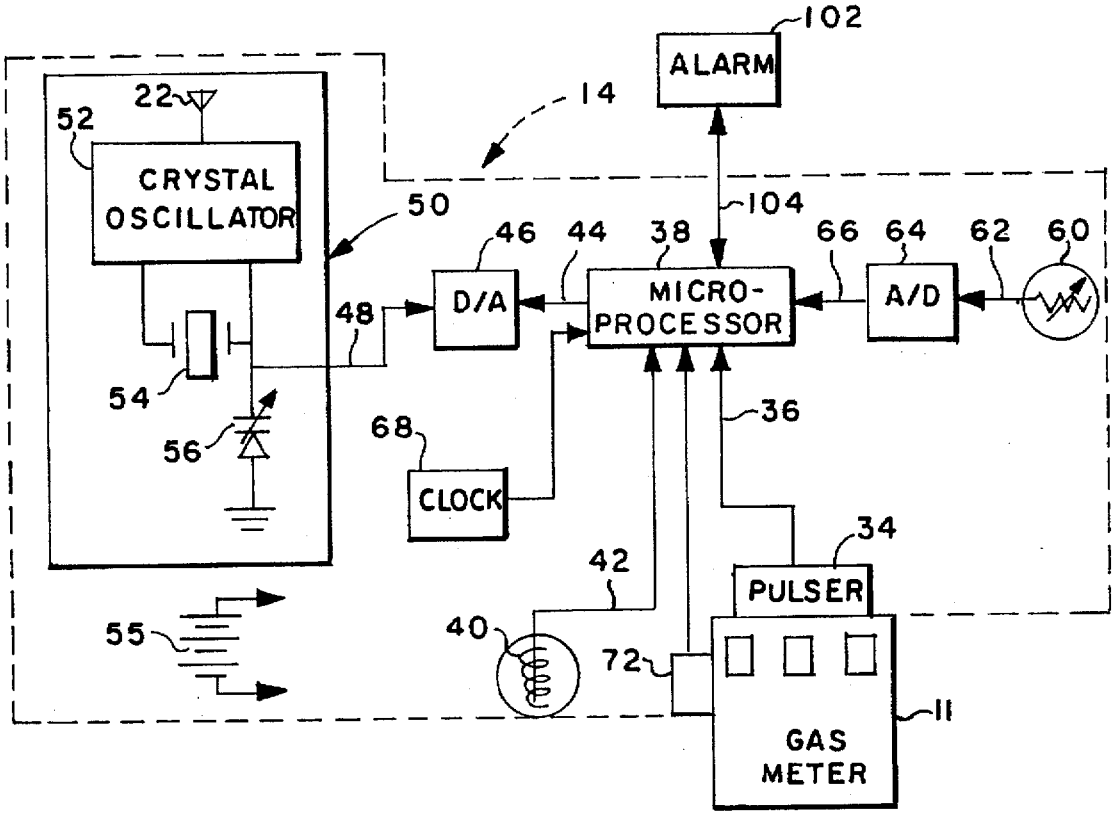
FIG. 3 is a schematic representation of a meter module constructed in accordance with the present invention.

A typical meter module 14, illustrated in FIG. 3, includes a pulser 34, a microprocessor 38, and a crystal oscillator transmitter 50. The pulser 34 detects utility usage at a gas, electricity or water meter 11 and sends a signal over line 36 to the microprocessor 38. The pulser 34 will send the pulse to the microprocessor 38 every time the utility meter 11 registers the use of a predetermined amount of metered utility, for example, every 0.1 KW hours for an electric meter, or every cubic foot for a gas or water meter. The microprocessor 38 includes a counter-circuit (not illustrated) which is energized by the signal on line 36 to enable the microprocessor 38 to store therein utility usage-related information. Instead of a pulser, an encoder or other means can be utilized to generate data to the microprocessor 38 which is indicative of utility usage.

The microprocessor can also store therein information related to the utility meter 11 with which it is associated. For example, the microprocessor can store therein information related to the user's account number and the identity of the particular meter being read. An inductive coil 40 is provided which can be sealed within the module 14 and which can have a signal induced therein which is directed along line 42 to the microprocessor 38 to program the microprocessor with information relative to the particular meter and user with which the microprocessor 38 and module 14 is associated. In addition, the coil 40 can be utilized to program module 14 to effect operation of the module 14 either in the NEWLY INSTALLED MODE or NORMAL TRANSMISSION MODE. The pulser 34, inductive coil 40, and the microprocessor 38 can be similar to that disclosed in the Sears U.S. Pat. No. 4,463,354, entitled "Apparatus for Communicating Utility Usage-Related Information from a Utility Usage Location to a Portable Utility Usage Registering Device," which patent is incorporated herein by reference, In addition, the operation of the meter module 14 is more fully disclosed in the Sears U.S. patent application Ser. No. 08/119,986, filed Sep. 10, 1993, entitled "Apparatus for Communicating Utility Usage-Related Information from a Utility Usage Location to a Utility Usage Registering Device," which is also incorporated herein by reference.

The microprocessor 38 periodically directs a signal on line 44 to a digital-to-analog converter 46 which outputs the signal to the input 48 of a transmitter 50. The transmitter 50 includes a crystal oscillator 52, a crystal 54, a varacter diode 56, and an antenna 22. The crystal 54 oscillates at a predetermined frequency, and the varacter diode 56 can be utilized to tune the crystal oscillator 52 and crystal 54. The crystal oscillator 52 and related components can preferably be provided on a single synthesizer chip such as MC13176 manufactured by Motorola. A voltage control oscillator (VCO) phase lock loop can be provided on the synthesizer chip to stabilize the output of the transmitter and allow the use of a low cost, stable, low frequency crystal to generate a high frequency signal of identical stability.

The transmitter 50 transmits a first signal indicative of utility usage information, which may include a flag, to the data accumulator units 18 at an accurately controlled fixed frequency. In many cases, the frequency (i.e. the carrier frequency of the transmission signal) is assigned by the FCC, is a very narrow frequency band, and must be accurately controlled so that the frequency does not wander into adjacent frequency bands. The crystal 54 and related components are temperature sensitive and vary in oscillating frequency when subjected to varying temperatures. The microprocessor 38 establishes a signal on the input 48 to the transmitter 50, which signal is a temperature compensated signal to compensate for the varying temperature of the crystal 54 and related components to enable the crystal oscillator 52 to transmit at an accurately controlled fixed frequency. The signal at the input 48 of the transmitter 50 includes a first component which comprises a rapidly varying stepped voltage for data transfer, and a second component which comprises a slowly varying DC signal established by microprocessor 38 for temperature compensation of transmitter 50.

The microprocessor 38 includes a look-up table therein which includes data indicative of the correct temperature compensated signal to be directed to the input 48 of the transmitter 50 to effect oscillation of the crystal 54 and output of the transmitter 50, when the transmitter 50 and its related components are at various temperatures which have been entered into the look-up table. Thus, the transmitter 50 is temperature compensated by the signal input 48 from the microprocessor 38.

A thermistor 60 is operable to sense the temperature of crystal 54 and transmitter 50 and establishes a temperature signal on line 62 to an analog digital converter 64 which directs the signal along line 66 to the microprocessor 38. The thermistor 60 provides a temperature signal to the microprocessor 38 which enables the microprocessor to determine from the look-up table therein the correct temperature compensated signal, dependent upon the actual sensed temperature of the transmitter 50, to be directed to the transmitter 50 to cause the transmitter 50 to transmit at an accurate predetermined frequency.

In the preferred embodiment, each module 14, including the transmitter 50, crystal 54, and thermistor 60 associated therewith, is "tested" at varying temperatures so that each module 14 can be individually calibrated in the look-up table and each microprocessor can be individually programmed to establish the correct temperature compensated signal at the input of the transmitter 50 when the transmitter is at various temperatures. The temperature compensated signal compensates for the non-linearity of the thermistor 60, crystal 54, and other components of the transmitter 50 which are "burned in" and calibrated as a unit. The individual calibration and compensation of each transmitter 50 and associated components allow for the use of lower cost component crystals without degrading the accuracy of the transmitted signal. In addition, to further improve the accuracy of the transmitter 50, the crystals 54 can be aged before they are utilized in the individual transmitters 50.

Each of the meter modules 14 is preferably powered by a battery 55 which eliminates the need for an external power source. The battery may be a lithium battery which is capable of powering meter module 14 for many years. In locations where power is readily available, the battery can be replaced by a conventional power supply.

Figure 4:
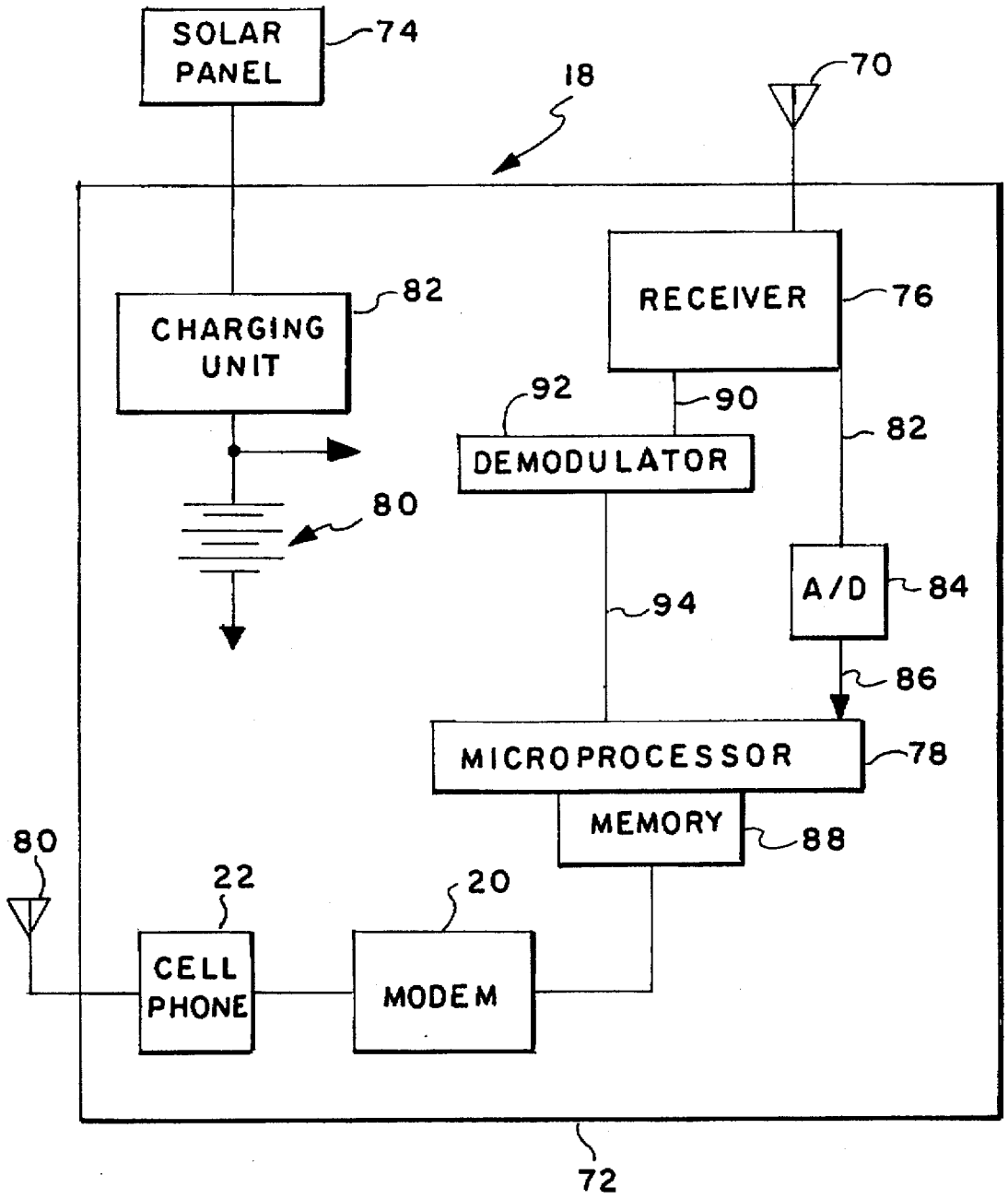
FIG. 4 is a schematic representation of a data accumulator unit constructed in accordance with the present invention.

A typical example of a data accumulator unit 18 is disclosed in FIG. 4. The data accumulator unit 18 is housed in a rugged, heavy gauge enclosure 72 suitable for mounting on a telephone pole. The pole-top mounting ability of the unit 18, not shown, enables the data accumulator units 18 to be placed at locations which are easily spaced apart and which are locations which would likely receive signals from the meter modules 14. External to the enclosure is a solar panel 74 and an omni-directional antenna 70. The data accumulator unit 18 includes a receiver 76 tuned to receive signals from the meter modules 14, a microprocessor 78, a modem 20, a rechargeable battery 80, and a cellular data phone 22. An antenna 80 is connected to the cellular phone in a known manner to enable the cellular phone 22 to communicate with the control computer 24. The rechargeable battery 80 enables the data accumulator unit 18 to not require any attachments to power lines and the cellular phone 22 does not require any attachments to telephone lines to simplify site selection and installation. The rechargeable battery 80 will provide power for several weeks of operation to allow for cloudy periods, and the solar panel 74 will charge the rechargeable battery in a well-known manner via a charging circuit 82. In general, four hours of sunshine per week will provide adequate power. In the preferred embodiment the data accumulator units 18 are adapted to communicate with the computer on a periodic basis and the control computer 24 can not communicate with each data accumulator unit 18 unless the cell phone of the data accumulator unit 18 has established a communications link with the control computer 24. This mode of operation consumes much less energy than if the data accumulation unit 18 was constantly "on" looking for a message from the control computer 24. The utilization of a data accumulator unit 18 which periodically transmits its data and then denergizes its data transfer circuitry until the next periodic transmission allows the unit 18 to be powered by a battery and a solar cell. However, in some cases it may be desirable to establish a two-way communication link with the data acumulator units 18 and this can be acomplished by providing a transmitting-receiving cell phone or an RF link with the control computer.

Each of the data accumulator units 18 is adapted to receive first signals indicative of utility usage from a plurality of meter modules 14 which are within transmission range of the data accumulator unit 18. The first signals are received by antenna 70 and are directed to the receiver 76. The receiver 76 includes analog circuitry therein to measure the signal strength of each of the received first signals. The signal strength value of the received first signals is directed from the receiver 76 over line 82 to an analog-to-digital converter 84 which converts the analog signal representative of received signal strength to a digital format. The analog-to-digital converter 84 directs the digital output along line 86 to the microprocessor 78 which then stores in memory 88 the signal strength of each of the received first signals from the meter modules 14. The received signal strength for each of the signals received by the data accumulator unit 18 from the meter modules 14 can be transmitted via the cell phone 22 to the control computer 24 which then ranks the signal strength for each signal and which then enables and instructs only particular data accumulator units 18 to receive, record and store signals from a particular meter module 14. The first signals from the meter modules 14 which are received at the data accumulator unit 18 by receiver 76 are directed along line 90 to a demodulator 92 which directs its output along line 94 to the microprocessor 78. The output of the demodulator on line 94 is indicative of the utility usage-related information and includes such information as user identification, utility usage, and an indication of tamper events which is also stored in memory 88.

The output of each data accumulator unit 18 is directed over a cellular phone 22 and antenna 80 to the data reduction and control computer 24. To this end, a plurality of modems 96 are connected to the control computer 24 for receiving signals from the cellular phones 22. Each of the modems 96 is connected to a telephone line 100 for receiving utility usage-related information from the cellular phones 22 associated with the data accumulator units 18. While a cellular phone 22 has been illustrated to provide data communication between the control computer 24 and the data accumulator units 18, other well-known methods of communication, such as telephone lines, RF links, or fiber optic cable, could be utilized to connect the data accumulator units 18 to the control computer 24.

An alarm sensing mechanism can be easily adapted to function with the system 10 of the present invention. To this end, an alarm 102 can be connected via line 104 to the microprocessor 38 to provide an indication of an alarm condition. The alarm could sense fire, smoke, CO, $CO_2$, natural gas, or could be connected to a security system. When alarm 102 senses an alarm condition, such as a gas leak, a signal is sent via line 104 to the microprocessor 38. This signal, indicative of an alarm condition, causes transmitter 50 to immediately transmit an alarm signal indicating the alarm condition and the identification or address of the particular module 14 with which the alarm is associated. The alarm signal from a particular meter module 14 can be received, recorded and stored at all data accumulator units 18 which are within range of the meter module 14 and which receive a first signal from the particular meter module, or can be received, recorded and stored only at the particular data accumulator units 18 which are instructed to receive, record and store signals from the particular meter module.

It should be realized that under normal operating conditions, only enabled data accumulator units will receive, record and store signals from a predetermined meter module. When a flag is included in the first signal from a particular meter module, the first signal will be received, recorded and stored at all data accumulator units which receive the first signal. Accordingly, if it is desired to have an alarm signal received, recorded and stored by all data accumulator units which are within transmission range of the particular meter module, the alarm signal can include a flag which will allow each data accumulator unit within range of the particular meter module 14 to receive, record and store the alarm signal.

When an alarm signal is received at a data accumulator unit 18, the alarm signal is immediately transmitted to the control computer 24 where an operator of the system can affect the necessary response to the alarm condition. Such response could include sending service personnel, sending fire trucks, police or other security personnel.

While the alarm 102 has been illustrated in FIG. 3 as being connected directly to the meter module 14, it should be apparent that the alarm 102 could be spaced apart from the electric or gas meter 11. In some instances, it may be desirable to space the alarm apart from the utility meter 11. Accordingly, when it is desired to space the alarm from the utility meter, the meter module 14 can be modified by eliminating the pulser and meter interface which is not required for an alarm module. Thus, a separate alarm module, not illustrated, can be provided which is similar to meter module 14 and which would include the alarm 102, the microprocessor 38, and the transmitter 50. The alarm can be located anywhere within the structure 16 and would not operate to transmit utility usage-related information other than the identification of the user (i.e. address or identification number), and the occurrence of an alarm condition. For example, if the alarm 102 is a gas sensor, it may be desirable to locate such gas sensor on the second floor of the residence whereas the utility meter may be located in the basement. It is not necessary to hard wire the alarm 102 to the meter module 14 associated with the utility meter 11. Rather, the alarm 102 is associated with a self-contained transmitter mechanism including the microprocessor 38 and transmitter 50 which transmits upon the occurrence of an alarm condition directly to the data accumulator units 18. If desired, the alarm can periodically transmit a status indicator indicating that the alarm module is operative. In such a manner, the present system can be utilized to transmit not only utility usage-related information, but alarm conditions such as fire, gas and security.

Figure 5:
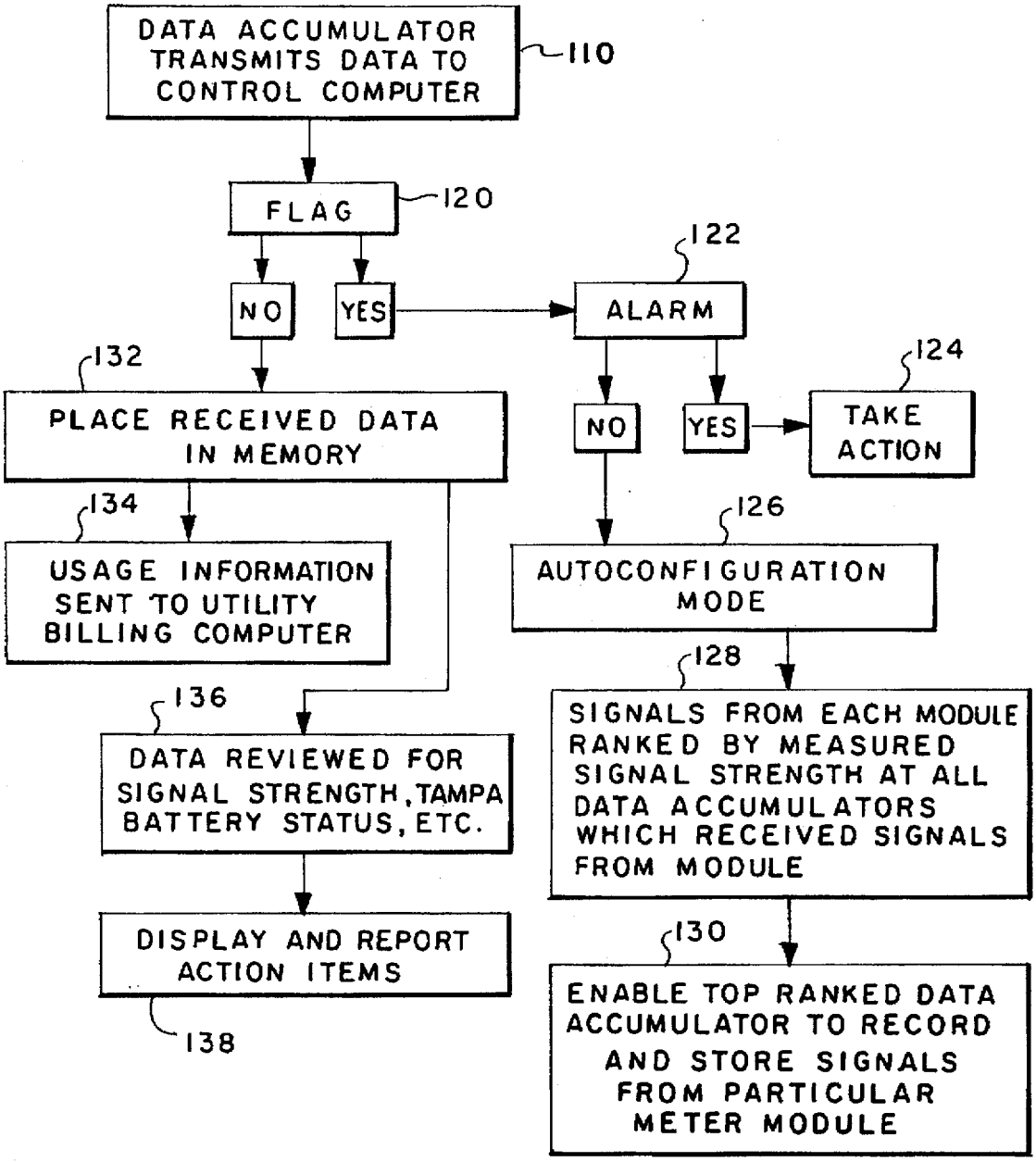
FIG. 5 is a simplified flow chart for the operation of the control computer.

FIG. 5 discloses a simplified flow chart for the operation of the control computer 24. Initially, the data accumulator units 18 transmit data to the control computer 24, as represented at 110. The data includes utility usage related information and an identification of the particular meter module 14 from which the data was received. The control computer first determines at 120 whether there is a flag in the signal transmitted from the data accumulator unit. If a flag is included in the signal, the control computer then determines, at 122, whether an alarm condition is present. If an alarm condition is present, the control computer signals an operator at 124 to take action. The action can include calling police, fire or other safety personnel. If a flag is present and an alarm condition is not present, the control computer goes into an autoconfiguration mode at 126. In this mode, the signals being processed are signals from a module 14 in its NEWLY INSTALLED MODE. In the autoconfiguration mode, the control computer 24 ranks, at 128, signals from each particular meter module 14 by measured signal strength at all the data accumulator units 18 which receive signals from a particular meter module 14. The control computer then enables, at 130, the top ranked (by received signal strength) data accumulator units which receive the strongest signals from a particular meter module 14. The enabled data accumulator units 18, which in the preferred embodiment include three or four top ranked data accumulator units, are then instructed to record and store signals from a particular meter module. All other data accumulator units 18 do not record and store signals from the particular meter module.

If a flag is not present in the data received at the control computer, the control computer 24 directs the received data at 132 to the memory of the control computer. The control computer 24 then processes the received data and billing information is sent at 134 to the utility billing computer 12 which generates bills in a well-known manner. The data in the memory of the control computer 24 can be reviewed at 136 for signal strength, tamper events, battery status, and/or other information which would require action. The control computer displays and reports action items at 138. For example, if a battery status indicator indicates a battery replacement is required, a report can be generated at 138 and a system operator can direct service personnel to correct the problem. If a decrease in signal strength at one of the enabled data accumulator units 18 for a particular meter module 14 is sensed, a report can be generated at 138 which would allow the operator to reconfigure the system by disenabling the particular data accumulator unit 18 which received the decreased signal strength and enabling another data accumulator unit 18 for a particular meter module 14.

From the foregoing, it should be apparent that a new and improved method of communicating utility usage-related information, including meter identification and utility usage data from a plurality of meter modules 14, each of which senses, stores and transmits utility meter-related information from an associated utility meter 11 to a plurality of spaced apart data accumulator units 18 is provided. Each of the data accumulator units 18 receives from a plurality of modules 14 first signals which are indicative of utility usage information associated with the meter module. The data accumulator units 18 further periodically transmit data indicative of some of the first signals received by the data accumulator units 18 to a control computer 24. The method includes the steps of periodically transmitting from each of the plurality of meter modules 14 a first signal indicative of utility usage information, receiving at each of the plurality of data accumulator units 18 a plurality of first signals, each of which is transmitted by its associated meter module 14, storing at each of the data accumulator units in the memory 88 data indicative of utility-related information received by the data accumulator units 18 from some of the first received first signals, transmitting to the control computer 24 data from the data accumulator units 18, and periodically transmitting a flag included in the first signal for a predetermined time period from each of the plurality of meter modules to the data accumulator units 18. The flag can be transmitted for a predetermined period of time when the meter module 14 is newly installed and can be utilized when an alarm condition is sensed to affect each data accumulator unit 18 within range of the meter module 14 to receive, record and store meter-related information and/or an alarm condition.

What I claim is:

1. A method of communicating utility usage-related information, including meter identification data and utility usage data from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal, and further periodically transmits data indicative of some of the first signals received by the data accumulator unit to a control computer comprising the steps of:

periodically transmitting from each of the plurality of meter modules a first signal indicative of utility usage-related information;

receiving at each of the plurality of data accumulator units a plurality of first signals, each of which is transmitted by its associated meter module;

storing at each of the data accumulator units data indicative of utility related information received by the data accumulator unit from some of said received first signals;

transmitting to the control computer data from each of the data accumulator units which is indicative of utility usage-related information sensed by said plurality of meter modules; and periodically transmitting a flag included in said first signal for a predetermined time period from each of said plurality of meter modules to said data accumulator units.

2. A method of communicating utility usage-related information as defined in claim 1 further including the step of:

measuring the received signal strength of at least some of said received first signals at each of said data accumulator units.

3. A method of communicating utility usage-related information as defined in claim 2 further including the step of:

storing the received signal strength of said received first signals for which the received signal strength is measured.

4. A method of communicating utility usage-related information as defined in claim 1 wherein said step of periodically transmitting a flag is performed when said meter module is initially installed at its associated utility meter.

5. A method of communicating utility usage-related information as defined in claim 1 further including the steps of:

filtering data stored at each of the data accumulator units to remove data from redundant first signals received at multiple data accumulator units from a particular meter module; and storing in said control computer a single set of data indicative of utility usage-related information for a particular meter module.

6. A method of communicating utility usage-related information as defined in claim 1 further including the steps of:

sensing an alarm condition and generating an alarm signal in response thereto;

communicating said alarm condition to said data accumulator units; and transmitting to the control computer from said data accumulator units said alarm signal.

7. A method of communicating utility usage-related information as defined in claim 6 wherein said step of transmitting a flag is performed when an alarm condition is sensed.

8. A method of communicating utility usage-related information from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal; and further periodically transmitting data indicative of some of the first signals received by the data accumulator unit to a control computer, comprising the steps of:

periodically transmitting from each of a plurality of meter modules a first signal indicative of utility usage-related information;

receiving at each of the plurality of data accumulator units a plurality of first signals, each of which is transmitted by its associated meter module;

storing at each of the data accumulator units data indicative of utility related information received by the data accumulator unit from some of said received first signals; and transmitting to a control computer data from each of the data accumulator units data which is indicative of utility usage-related information sensed by said plurality of meter modules; and wherein said step of periodically transmitting said first signal from each of said meter modules includes the steps of periodically transmitting at a first periodic frequency said first signal from each of said meter modules, and periodically transmitting at a second periodic frequency, which is larger than said first periodic frequency, said first signal from each of said meter modules.

9. A method of communicating utility usage-related information as defined in claim 8 wherein said step of periodically transmitting said first signal at a second predetermined frequency is performed for a predetermined time period when each of the meter modules is initially installed at its associated utility meter.

10. A method of communicating utility usage-related information as defined in claim 8 further including the step of:

measuring the received signal strength of at least some of said received first signals at each of the data accumulator units.

11. A method of communicating utility usage-related information as defined in claim 10 further including the step of:

storing the received signal strength of said measured first signals.

12. A method of communicating utility usage-related information from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal, and further periodically transmitting data indicative of some of the first signals received from the data accumulator units to a control computer comprising the steps of:

periodically transmitting from each of the plurality of meter modules a first signal indicative of utility usage-related information;

receiving at each of the plurality of data accumulator units a plurality of first signals, each of which is transmitted by its associated meter module;

measuring the received signal strength of at least some of said received first signals at each of said data accumulator units;

storing at each of the data accumulator units the received signal strength of said measured first signals received from a particular meter module;

storing at each data accumulator unit data indicative of utility related information received by the data accumulator unit from some of said received first signals; and transmitting to said control computer data from each of the data accumulator units which is indicative of utility usage-related information sensed by said plurality of meter modules.

13. A method of communicating utility usage-related information as defined in claim 12 further including the steps of:

sensing an alarm condition and generating an alarm signal in response thereto;

communicating said alarm condition to said data accumulator units; and transmitting to the control computer from said data accumulator units said alarm signal.

14. A method of communication utility usage-related information, including meter identification data and utility usage data from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal, and further periodically transmits data indicative of some of the first signals received by the data accumulator unit to a control computer comprising the steps of:

periodically transmitting from each of the plurality of meter modules a first signal indicative of utility usage-related information;

receiving at each of the plurality of data accumulator units a plurality of first signals, each of which is transmitted by its associated meter module;

storing at each of the data accumulator units data indicative of utility related information received by the data accumulator unit from some of said received first signals;

transmitting to the control computer data from each of the data accumulator units which is indicative of utility usage-related information sensed by said plurality of meter modules;

periodically transmitting a flag included in said first signal for a predetermined time period from each of said plurality of meter modules to said data accumulator units;

measuring the received signal strength of at least some of said received first signals at each of said data accumulator units;

storing the received signal strength of said received first signals for which the received signal strength is measured;

said steps of measuring and storing the received signal strength of said received first signals are performed at the data accumulator units;

transmitting to said control computer the received signal strength of said received first signals for which said signal strength is measured which is received and stored at each of said data accumulator units;

comparing the received signal strength for each first signal including a flag associated with a particular meter module which first signal is received at a plurality of data accumulator units;

determining and ranking by signal strength which of the plurality of data accumulator units received the strongest first signals for a particular meter module; and enabling only a limited number of data accumulator units which have received the strongest first signals, including a flag from a particular meter module, to receive, record and store the data indicative of utility usage-related information at a particular meter module.

15. A method of communicating utility usage-related information as defined in claim 14 further including the steps of:

transmitting at a first periodic frequency said first signal from said meter module to said data accumulator units when said flag is not included in said first signal; and transmitting at a second predetermined frequency, which is larger than said first predetermined frequency, when said first signal from said meter modules to said data accumulator units includes said flag.

16. A method of communicating utility usage-related information as defined in claim 14 further including the steps of:

determining a decrease in strength of said received signal strength at a particular enabled data accumulator unit of the first signals associated with a particular meter module for which the particular data accumulator unit was enabled to receive, record and store said first signals;

disenabling the particular data accumulator unit from storing the first signal from a particular meter module when a predetermined decrease in strength of said received signal strength is determined at said particular data accumulator unit; and enabling and instructing another data accumulator unit which has been ranked and determined to receive the next strongest received signal strength for the first signal including a flag from a particular meter module to receive, record and store said first signal from said particular meter module.

17. A method of communication utility usage-related information, including meter identification data and utility usage data from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal, and further periodically transmits data indicative of some of the first signals received by the data accumulator unit to a control computer comprising the steps of:

periodically transmitting from each of the plurality of meter modules a first signal indicative of utility usage-related information;

receiving at each of the plurality of data accumulator units a plurality of first signals, each of which is transmitted by its associated meter module;

storing at each of the data accumulator units data indicative of utility related information received by the data accumulator unit from some of said received first signals;

transmitting to the control computer data from each of the data accumulator units which is indicative of utility usage-related information sensed by said plurality of meter modules;

periodically transmitting a flag included in said first signal for a predetermined time period from each of said plurality of meter modules to said data accumulator units;

transmitting at a first periodic frequency said first signal from said meter module to said data accumulator units when said flag is not included in said first signal; and transmitting at a second predetermined frequency, which is larger than said first predetermined frequency, when said first signal from said meter modules to said data accumulator units includes said flag.

18. A method of communicating utility usage-related information as defined in claim 17 wherein said step of periodically transmitting a flag is performed when said meter module is initially installed at its associated utility meter.

19. A method of communicating utility usage-related information from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter module which transmits said first signal; and further periodically transmitting data indicative of some of the first signals received by the data accumulator unit to a control computer, comprising the steps of:

periodically transmitting from each of a plurality of meter modules a first signal indicative of utility usage-related information;

receiving at each of the plurality of data accumulator units a plurality of first signals, each of which is transmitted by its associated meter module;

storing at each of the data accumulator units data indicative of utility related information received by the data accumulator unit from some of said received first signals; and transmitting to a control computer data from each of the data accumulator units data which is indicative of utility usage-related information sensed by said plurality of meter modules;

wherein said steps of periodically transmitting said first signal from each of said meter modules includes the steps of periodically transmitting at a first periodic frequency said first signal from each of said meter modules, and periodically transmitting at a second periodic frequency, which is larger than said first periodic frequency, said first signal from each of said meter modules;

measuring the received signal strength of at least some of said received first signals at each of the data accumulator units;

storing the received signal strength of said measured first signals;

transmitting to said control computer the received signal strength of at least some of said received first signals which are received by each of said data accumulator units;

comparing the received signal strength for the first signals associated with a particular meter module which first signals are received at a plurality of data accumulator units;

determining and ranking by signal strength which of the plurality of data accumulator units received the strongest first signals from a particular meter module; and enabling only a limited number of data accumulator units which have received the strongest first signals from a particular meter module to receive, record and store the data indicative of utility usage-related information at the particular meter module.

20. A method of communicating utility usage-related information as defined in claim 19 further including the step of periodically transmitting a flag included in said first signal.

21. A method of communicating utility usage-related information as defined in claim 20 wherein said step of periodically transmitting a flag is performed when said meter module is initially installed at its associated utility meter.

22. A method of communicating utility usage-related information as defined in claim 20 further including the steps of:

sensing an alarm condition and generating an alarm signal in response thereto;

communicating said alarm condition to said data accumulator units; and transmitting to said control computer from said data accumulator units said alarm signal.

23. A method of communicating utility usage-related information as defined in claim 22 wherein said step of transmitting a flag is performed when an alarm condition is sensed.

24. A method of communicating utility usage-related information from a plurality of meter modules, each of which senses, stores and transmits utility meter related information from an associated utility meter to a plurality of spaced-apart data accumulator units, each of which receives from a plurality of meter modules a plurality of first signals, each of which is indicative of said utility usage information associated with the meter modules which transmits said first signal, and further periodically transmitting data indicative of some of the first signals received from the data accumulator units to a control computer comprising the steps of:

periodically transmitting from each of the plurality of meter modules a first signal indicative of utility usage-related information;

receiving at each of the plurality of data accumulator units a plurality of first signals, each of which is transmitted by its associated meter module;

measuring the received signal strength of at least some of said received first signals at each of said data accumulator units;

storing at each of the data accumulator units the received signal strength of said measured first signals received from a particular meter module;

storing at each data accumulator unit data indicative of utility related information received by the data accumulator unit from some of said received first signals;

transmitting to said control computer data from each of the data accumulator units which is indicative of utility usage-related information sensed by said plurality of meter modules;

transmitting to said control computer the measured signal strength of said measured first signals which are received by the data accumulator units;

comparing and ranking by signal strength the measured first signals associated with a particular meter module which first signals are received at a plurality of data accumulator units;

determining which data accumulator units received the strongest first signals from a particular meter module; and enabling and instructing a limited number of data accumulator units which received the strongest first signals from a particular meter module to receive, record and store the data indicative of utility usage-related information at the particular meter module.

25. A method of communicating utility usage-related information as defined in claim 24 further including the steps of:

measuring at each of said data accumulator units the received signal strength of said first signals at said data accumulator units which are enabled to receive, record and store the particular first signals associated with a particular meter module;

determining a decrease in strength of a received first signal at a particular enabled data accumulator unit for receiving the first signals associated with a particular meter module;

disenabling the particular data accumulator unit from recording and storing the first signals from a particular meter module when a predetermined decrease in strength of said received signal is determined at said particular data accumulator unit; and enabling and instructing another data accumulator unit which has been determined to receive the next strongest first signal from a particular meter module to receive, record and store said first signals from said particular meter module.

26. A method of communicating utility usage-related information as defined in claim 25 further including the steps of:

filtering data stored at each of the data accumulator units to remove data from redundant first signals received at multiple enabled data accumulator units from a particular meter module; and storing at said control computer a single set of data indicative of utility usage-related information for a particular meter module.

27. A method of communicating utility usage-related information as defined in claim 26 further including the step of:

periodically transmitting a flag included in said first signal for a predetermined period of time from each of the plurality of meter modules to the data accumulator unit.

28. A method of communicating utility usage-related information as defined in claim 27 wherein said step of periodically transmitting a flag in said first signal is performed when said meter module is initially installed.

29. A method of communicating utility usage-related information as defined in claim 27 further including the steps of:

sensing an alarm condition and generating an alarm signal in response thereto;

communicating said alarm condition to said data accumulator units; and transmitting to the control computer from said data accumulator units said alarm signal.

30. A method of communicating utility usage-related information as defined in claim 29 wherein said step of transmitting a flag is preformed when an alarm condition is sensed.

* * * * *